US005254270A

United States Patent [19]

Birkhan et al.

[11] Patent Number: 5,254,270

[45] Date of Patent: Oct. 19, 1993

[54] FABRIC SOFTENERS BASED ON QUATERNARY POLY(OXYALKYLENE) ALKANOLAMINE ESTERS

[75] Inventors: Horst Birkhan, Steinau-Ulmbach; Michael Fender, Soden-Salmunster, both of Fed. Rep. of Germany

[73] Assignee: Rewo Chemische Werke GmbH, Fed. Rep. of Germany

[21] Appl. No.: 850,578

[22] Filed: Mar. 13, 1992

[30] Foreign Application Priority Data

Mar. 13, 1991 [DE] Fed. Rep. of Germany ..... 4108025

[51] Int. Cl.[5] ..... D06M 13/46

[52] U.S. Cl. ..... 252/8.8; 252/8.6; 252/8.9; 252/546; 252/547

[58] Field of Search ..... 252/8.9, 546, 547, 8.6, 252/8.8

[56] References Cited

U.S. PATENT DOCUMENTS

| | | | |
|---|---|---|---|
| 2,017,051 | 10/1935 | Ransom et al. | 260/127 |
| 2,078,922 | 5/1937 | Arnold | 260/127 |
| 4,931,216 | 6/1990 | Igarashi et al. | 252/8.8 |
| 4,946,627 | 8/1990 | Leighton et al. | 252/546 |
| 5,093,014 | 3/1992 | Neillie | 252/8.8 |

FOREIGN PATENT DOCUMENTS 384714 12/1932 United Kingdom .

*Primary Examiner*—Anthony McFarlane
*Attorney, Agent, or Firm*—Scully, Scott, Murphy & Presser

[57] ABSTRACT

Fabric softeners in the form of aqueous solutions, emulsions or dispersions contain as quaternary ammonium compounds at least one compound of the general formula (1)

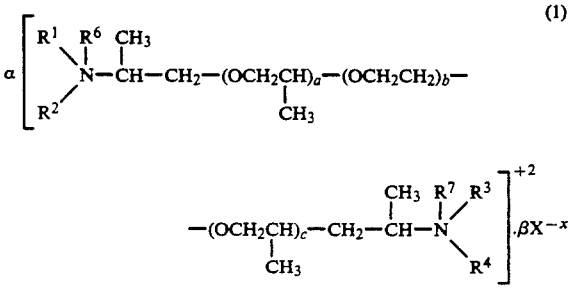

32 Claims, No Drawings

FABRIC SOFTENERS BASED ON QUATERNARY POLY(OXYALKYLENE) ALKANOLAMINE ESTERS

The present invention relates to fabric softeners in the form of aqueous solutions, emulsions or dispersions.

In the washing of textiles it is customary to employ in the last wash cycle fabric softeners in order that harshening of the fabrics by drying be avoided and the fabric hand of the treated textiles positively influenced.

The fabric softeners used are customarily cationic compounds, for example quaternary ammonium compounds which in addition to long-chain alkyl radicals may also contain ester or amide groups. It is also advantageous to use mixtures of different softening components which are added to the rinse bath in the form of aqueous dispersions.

These cationic compounds are effective softeners when used in the last rinse bath, but they do have some disadvantages in use.

One of the disadvantages of such agents is that the softening components are not dispersible in cold water; another is that the textiles treated therewith possess unsatisfactory remoisture capability.

Remoisture capability for the purposes of the present invention is the ability of the fiber to reabsorb moisture. Inadequate remoisture capability is a disadvantage whenever textile fabrics are to absorb major quantities of moisture from the surface of the skin, for example in the case of hand and bath towels, underwear and bed linen.

It is an object of the present invention to overcome the abovementioned disadvantages of conventional fabric softening formulations and to make available fabric softeners which combine ready biodegradability and a soft fabric hand with improved remoisture capability and which give a clear solution in water or exhibit significantly improved emulsifiability or dispersibility in water.

This object is achieved, surprisingly, by fabric softeners comprising ammonium compounds which contain ester groups and a liquid carrier material.

The present invention accordingly provides aqueous fabric softeners comprising

A) from 5 to 35% by weight of at least one of the compounds of the general formula (1):

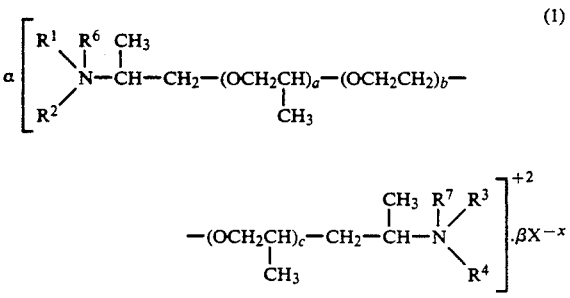

(1)

wherein $R^1$, $R^2$, $R^3$ and $R^4$ are identical or different radicals of the formula

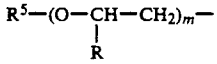

wherein each R can independently be —H or —$CH_3$; $R^5$ can be a substituted or unsubstituted acyl radical of 6–22, preferably 8–18, carbon atoms with or without a double bond, or can be H, and wherein at least one, and preferably at least two, of the $R^5$ radicals represent such an acyl radical and at least one of the $R^5$ radicals is H; and $R^6$ and $R^7$, which can be identical or different, are each selected from the group consisting of H, —$CH_3$, —$C_2H_5$ and —$C_2H_4OH$:

$X^{-x}$ is at least one organic and/or inorganic anion; x is 1, 2 or 3;

a, b and c are each 0–20;

n is the sum of (a+b+c) and is 1–30, preferably 1–15, and more preferably 2–8; and m is 1–5, provided that the sum of all m's is at least 4; 8 is 1 or 2; α equals the product (0.5)(α)(x); and optionally B) 10–90 by weight, based on the weight of component A), of conventional ammonium compounds; and optionally C) 1–5% by weight of the entire composition of customary dyes, scents and further customary fabric softener auxiliaries and additives, and water to 100% by weight.

A further aspect of the present invention comprises aqueous fabric softeners which comprise 15–30% by weight of a compound of the general formula (1) wherein R is —$CH_3$, two or three of the radicals $R^1$, $R^2$, $R^3$ and $R^4$ are each $R^5$—O—$CH_2$—$CH_2$—wherein $R^5$ is an acyl radical of 8–18 carbon atoms and the other one or two of the $R^1$, $R^2$, $R^3$ and $R^4$ radicals are HO—$CH_2$—$CH_2$—; n is 1–15; $R^6$ and $R^7$, which can be identical or different, are each —H or —$CH_3$; and X—is a radical of a substituted or unsubstituted carboxylic acid having 1–8 carbon atoms in the main chain or the methosulfate or ethosulfate radical.

A further aspect of the present invention comprises aqueous fabric softeners comprising 15–30% by weight of a compound of the general formula (1) where R is —$CH_3$, three of the radicals $R^1$, $R^2$, $R^3$ and $R^4$ are each $R^5$—O—$CH_2$—$CH_2$—where $R^5$ is an acyl radical of 8–18 carbon atoms, one of the radicals $R^5$ is H, n is 2–8, $R^6$ and $R^7$ are each H and X—is the lactate radical.

Further aspects of the invention are defined by the claims.

Possible starting compounds for preparing the ammonium compounds used according to the present invention are the following amine compounds of the formula (2):

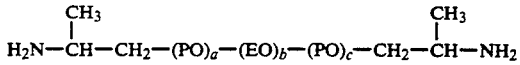

(2)

where PO is

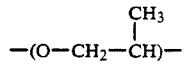

and EO is —(O—$CH_2$—$CH_2$)—and where a, b and c are each 0–20 with a+b+c=n=1–30, preferably 1–15, in particular 2–8. Preference for the purposes of the present invention is given to compounds where a+c-=1–15, in particular 2–8, and b=0.

These compounds are commercially available and are obtained by known methods by reacting polyoxyalkylene alcohols with ammonia under superatmospheric pressure.

Polyoxyalkylene alcohols are prepared by addition of an alkylene oxide, essentially propylene oxide, ethylene oxide or a mixture of the two, in a conventional manner to a compound which contains one or more active hydrogen atoms, or by polymerization of alkylene oxides.

As compounds which contain one or more active hydrogen atoms it is possible to use monoalcohols such as ethanol, isopropanol, butanol, lauryl alcohol, stearyl alcohol, but in particular methanol, or glycols such as ethylene glycol, propylene glycol, diethylene glycol, glycerol, trimethylolpropane, pentaerythritol, sorbitol, polyglycerol and polyvinyl alcohols.

The polyoxyalkylene alcohols have molecular weights within the range from about 100 to 10,000, preferably about 130–5,000, particularly preferably about 150–2,000.

Further conversion into amines takes place in a conventional manner by aminolysis of the free hydroxyl groups or esters thereof, in particular the sulfuric esters. In the case of higher alcohols, the OH group is exchanged for the amino group by a homogeneous or in particular heterogeneous catalysis over fixed-bed catalysts. Two methods in particular are available here. One involves dehydrating catalysts, the other hydrogenating-dehydrogenating catalysts.

Concerning temperature and pressure effects, the effect of excess ammonia and the residence times required, extensive literature is available in each case (cf. Houben-Weyl, Methoden der organischen Chemie, Georg Thieme Verlag, Stuttgart 1957, volume 11/1 pp. 108 and British Patent 384,714 and U.S. Pat. Nos. 2,017,051 and 2,078,922).

Preference for the purposes of the present invention is given to the following compounds of the formula (2):

$$a + c = 2 - 8 \quad b = 0 \qquad \text{(I)}$$

or

-continued $$a + c = 2 - 3 \quad b = 6 - 9 \qquad \text{(II)}$$

The compounds of the formula (2) are subsequently conventionally alkoxylated, i.e. preferably ethoxylated or propoxylated. In general this comprises reacting the amines in a pressure reactor at 120°–160° C., in the presence or absence of basic, in particular alkaline, catalysts, at 1–4 bar with an amount of alkylene oxide, preferably according to the present invention ethylene oxide and propylene oxide or mixtures thereof, in an amount corresponding to the desired degree of alkoxylation.

The products are compounds of the general formula

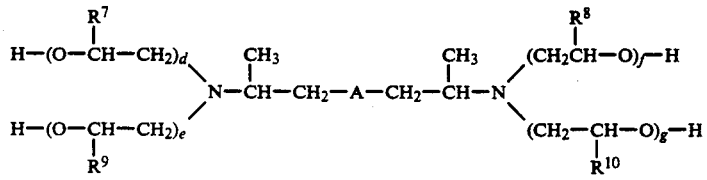

(3)

where A is $-(PO)_a-(EO)_b-(PO)_c$ and where a, b, c, EO and PO are each as defined above and $(d+e+f+g)=4–20$ and $R^7$, $R^8$, $R^9$ and $R^{10}$ can be independently of one another —H or $-CH_3$.

Preferred compounds of the formula (3) are compounds where $$d+e+f+g=m=4–6 \qquad \text{(III)}$$

$$R^7, R^8, R^9 \text{ and } R^{10}=H$$

The subsequent esterification of the compounds (3) with carboxylic acids or derivative thereof leads to compounds of the general formula (4):

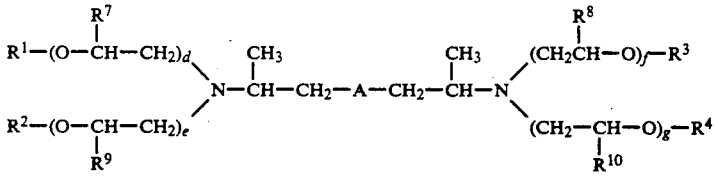

(4)

where A, d, e, f, g, $R^1$, $R^2$, $R^3$, $R^4$, $R^7$, $R^8$, $R^8$ and $R^{10}$ are each as defined above.

The fatty acids used for the esterification or transesterification are the monobasic synthetic fatty acids which are known and customary in this field, but in particular the fatty acids based on natural vegetable and animal oils of 6–22 carbon atoms, in particular 8–18 carbon atoms, for example coconut fatty acids and palm, tallow and ricinous fatty acids. They can be used not only as glycerides but also as esters with short-chain alcohols or as free acids.

Their esterification or transesterification is carried out in a conventional manner.

The alkanolamines of the formula (4) are reacted with an amount of fatty acid or fatty acid ester corresponding to the desired degree of esterification at 160°–240°

C. in the presence or absence of a catalyst, and the water or alcohol formed in the course of the reaction is distilled off continuously to complete the reaction, if necessary under reduced pressure.

Preferred compounds of the formula (4) are substances where one of the $R^1$, $R^2$, $R^3$, $R^4$ radicals is —H and three of them are 1×H $$-\underset{\underset{O}{\|}}{C}-R^{11} \qquad \text{(IV)}$$

$R^{11}$ being $-C_{17}H_{35}$ or having been derived from the natural mixture of coconut fatty acids.

The quaternization or preparation of the salts of the compounds (4) can be carried out by the methods known in this field and leads to the novel ester-amine quats or salts of the general formula (1) where $R^6$ and $R^7$ are each as defined above.

The salts can in general be prepared by adding the acids, optionally as aqueous or alcoholic solutions, in an amount corresponding to the desired degree of salt formation in portions and with thorough stirring to the initially charged poly(oxyalkylene)alkanolamine esters at 20°-80° C., with or without cooling. Quaternization is effected in a generally known manner whereby the poly(oxyalkylene)alkanolamine esters are heated to 80°-80° C. in the presence or absence of a solvent and admixed portionwise with the quaternizing agent in an amount corresponding to the desired degree of quaternization.

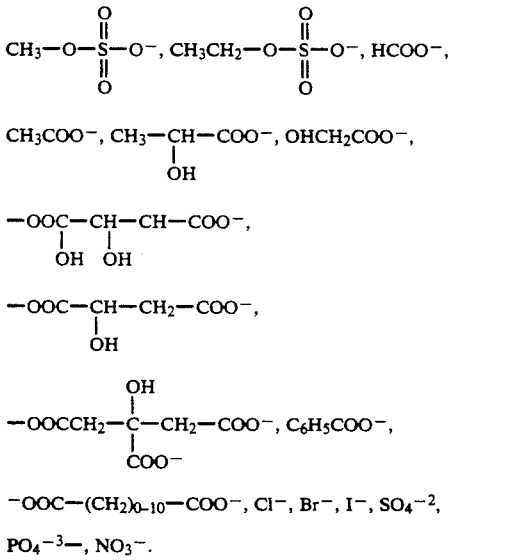

It will thus be recognized that the anions useful in this invention include anions of carboxylic acids capable of forming one, two or three carboxylate (—COO—) groups.

Particular preference for the purposes of the present invention is given to the anions

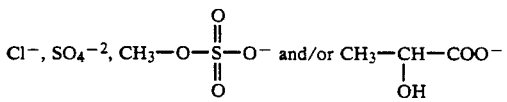

it also being possible for a plurality of anions to be present side by side and for them to be added in an amount such that the resulting pH of the total mixture of a 30% strength mixture is between 2-6, preferably 3-5. Of course, the relative amounts of the quaternary compound and the anion(s) present must be such that they neutralize each other; that is, referring to formula(1), $\alpha$ equals one-half the product of $\beta$ times the valence of the anion X.

The compounds of the general formula (1) used for the purposes of the present invention can be used alone or as mixtures, in which case—depending to some extent on the structure of the compounds of the general formula 3—the triesters of the general formula (1) can be converted predominantly into dispersions and the diesters of the general formula (1) into solutions.

To prepare solutions it is preferable for the purposes of the present invention to use compounds of the general formula (1) where $X^{-x}$ is a methosulfate or in particular a lactate radical. It has been found, surprisingly, that these solutions confer on textiles treated therewith not only a soft fabric hand but also excellent remoisture capability even without the use of customary ammonium salts, quaternized ammonium compounds and other auxiliaries and additives customary in this field.

Despite the omission of otherwise customary auxiliaries it is possible to prepare highly concentrated solutions which contain up to 35% by weight of pure active ingredient. The solutions are not only readily preparable using standard stirring equipment but also are free of the known problems which can arise with the storage of dispersions.

Whereas, as mentioned, the diester compounds can be prepared by simply dissolving them in cold or, more speedily, hot water, the triester compounds are emulsified or dispersed in a conventional manner using customary equipment and the known auxiliaries and additives.

In departure from or modification of existing procedures, which customarily take the form of preheating the water up to about 10° C. below the clear melting range of the softeners, the compounds according to the present invention can also be incorporated at room temperature (20°-25° C.). Thorough stirring is employed to disperse first the dye solution in the water, then the optionally necessary antifoam emulsion and finally the individual softeners in succession or mixed. After addition of an aliquot of an electrolyte solution (if necessary), perfume oil is metered in, followed by the remaining electrolyte solution. For the purposes of the present invention it is preferable not add an electrolyte solution.

The fabric softeners according to the present invention can each contain one or more of the components of the general formula (1) and optionally in addition 10-50% by weight, preferably 10-30% by weight, based on the amount of the compounds of the general formula (1), of one or more compounds of the formula (5) which can be prepared from hydroxyalkylenediamines and $C_{16}$-$C_{22}$ fatty acid in molar ratios of from 1:2 to 1:1:

$$R^{11}-CO-NH-R^{13}-N(-R^{12}OH)-COR^{11}\,.\,X^{-1} \qquad (5)$$

where $R^{11}$ is a substituted or unsubstituted alkyl or alkylene radical of 15-21 carbon atoms and $R^{12}$ and $R^{13}$ are divalent $C_1$-$C_3$-alkylene radicals, and/or (6) substituted imidazolines of the general formula

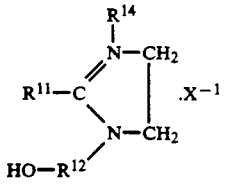

(6)

where $R^{11}$ and $R^{12}$ are each as defined above and $R^{14}$ is H or a $C_1$-$C_4$-alkyl or -hydroxyalkyl radical, and/or (7) compounds of the formula

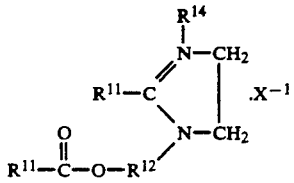

(7)

where each $R^{11}$, $R^{12}$ and $R^{14}$ is independently as defined above, and/or (8) reaction products of $C_{16}$-$C_{22}$ fatty acids with dialkylenetriamines in a molar ratio of 2:1

$$R^{11}—CO—NH—R^{12}—N(R^{14})_2—R^{13}—NHCOR^{11} \cdot X^{-1} \quad (8)$$

where $R^{11}$, $R^{12}$, $R^{13}$ and $R^{14}$ are each independently as defined above, and/or (9) substituted imidazolines of the general formula

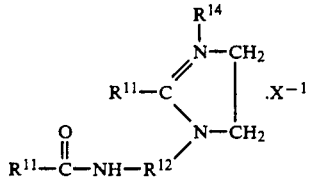

(9)

where $R^{11}$, $R^{12}$ and $R^{14}$ are each independently as defined above, and wherein the compounds of the formulae (5) to (9) can each be present independently of one another, as a whole or in part, in the form of their salts with organic and/or inorganic acids or in the form of their quaternary compounds, and/or

(10) quaternary ammonium compounds of the general formula $$[NR^{15}R^{16}R^{17}R^{18}]^+X^- \quad (10)$$

where $R^{15}$ is a substituted or unsubstituted alkyl or alkylene radical of 16–22 carbon atoms, $R^{16}$ and $R^{17}$ are independently of one another $C_1$-$C_4$-alkyl or-hydroxyalkyl radicals, $R^{18}$ is the same as $R^{15}$ or $R^{16}$, and $X^-$ is an anion.

These products are commercially available for example under the registered trademark REWOQUAT of REWO Chemische Werke GmbH, Steinau an der Straße, or the registered trademark VARISORT of Sherex Chemicals Group, Inc., Ohio, USA.

The mixing ratios in which these compounds are added can be optimized by the person skilled in the art on the lines of generally known criteria by means of a few orienting experiments.

In addition to the softening components of the general formula (1) the fabric softeners according to the present invention can include the customary auxiliaries and additives. These are in particular dyes, scents, electrolytes and high molecular weight ether compounds for viscosity regulation, small amounts of organic solvents and—provided they have no adverse effect on the remoisture capability—customary cationic and/or nonionic surfactants.

By combining the components of the general formula (1) and optionally commercially available quaternary ammonium compounds and optionally auxiliaries it is possible to prepare fabric softeners which give a clear solution in water or are readily emulsifiable or dispersible and confer not only a pleasantly soft fabric hand but also improved remoisture capability on textile materials, in particular those made of natural and regenerated cellulose and also wool and terry.

The fabric softeners according to the present invention are therefore used not only on the usual textile materials but in particular wherever large amounts of wetness and moisture are to be removed from the body surface within a short time, such as on hand or bath towels. But the fabric softeners are also successfully usable where moisture has to be absorbed directly from the skin within longer time spans, such as on underwear or bed linen.

Like the prior art fabric softeners, the fabric softeners according to the present invention are added to the last rinse cycle immediately following the actual washing process. The concentration used after dilution with water varies with the field of application within the range from 0.1 to 10 g of fabric softener per liter of wash water.

In the examples which follow, the analytical methods employed are those generally customary in this field, specifically:

1. Total amine number (TOT), tertiary amine number (TERT)

The total amine number indicates the number of milligrams of potassium hydroxide which are equivalent to the total amine basicity of 1 g of the amine compound (mg of KOH/g). The tertiary amine number indicates the number of milligrams of potassium hydroxide which are equivalent to the tertiary amine basicity of 1 g of the amine compound.

The values are determined by A.O.C.S. Official Method Tf 2a- 64.

2. Saponification number (SN)

The saponification number is a measure of the free and bound acids contained in fats and technical grade fatty acids. It indicates the number of milligrams of potassium hydroxide required to saponify 1 gram of fat or technical grade fatty acid (mg of KOH/g).

The values are determined by the standard methods of the German Society for Fat Chemistry (DGF): DGF C-V3.

3. Hydroxyl number (OHN)

The hydroxyl number is used to determine the hydroxyl group content and it indicates the number of milligrams of potassium hydroxide necessary for neutralizing the acetic acid consumed by 1 gram of fat in the course of acetylation (mg of KOH/g).

The values are determined by DGF standard method C-V17a.

4. Acid number (AN)

The acid number is the measure of the free acid content of a fat or technical grade fatty acid and indicates the milligrams of potassium hydroxide which are necessary for neutralizing 1 gram of substance.

The values are determined by DGF standard method C-V4.

5. Cationics content (cat $SO_3$)

This method is used for determining the level of cationic substances. Here the cationic substances are long-chain compounds which contain quaternary ammonium groups. The content is reported in percent of quaternary compound calculated as $SO_3$ equivalent with a molecular weight of 80 g/mol.

It is determined by a two-phase titration as described in ISO standards 2871-1 and 2871-2 (1988 E).

Preparation of poly(oxyalkylene)ammonium alkanol esters Examples

I. Preparation of hydroxylamines of formula (3)

Example 1

912 g (2 mol) of an amine of formula (2) where a+c=6.6 b=0 were admixed in an autoclave at 145°-160° C. with 352 g (8 mol) of ethylene oxide in portions so that the pressure was maintained between 1-3 bar. Complete reaction of the added amount of ethylene oxide gave 1.264 g of a light-colored liquid of general formula (3) where a+c=6.6 b=0 d+e+f+g=m=4 and $R^7$, $R^8$, $R^9$, $R^{10}$=H

This compound had a total amine number (TOT) of 179 mg of KOH/g, a tertiary amine number (TERT) of 175 mg of KOH/g and a hydroxyl number (OHN) of 348 mg of KOH/g.

The examples listed in Table I were prepared in a similar manner to Example 1.

TABLE I

| | Use of Compounds of Formula 2 Where | | | | | Resulting Compounds of Formula 3 Where | | | | |
|---|---|---|---|---|---|---|---|---|---|---|
| Ex. | a + c = | b = | mol | EO*) mol | PO* mol | d + e + f + g = m = | $R^7$-$R^{10}$ | TOT | TERT | OH-N |
| 2 | 6.6 | 0 | 2 | 8 | — | 8 | H | 141 | 141 | 296 |
| 3 | 2.8 | 0 | 1 | 4 | — | 4 | H | 275 | 268 | 567 |
| 4 | 2.8 | 0 | 1 | 8 | — | 8 | H | 197 | 197 | 439 |
| 5 | 2.5 | 9 | 1 | 4 | — | 4 | H | 144 | 142 | 291 |
| 6 | 6.6 | 0 | 2 | — | 8 | 4 | $CH_3$ | 163 | 162 | 323 |

*)EO = ethylene oxide
*PO = propylene oxide

II. Preparation of ester-amines of formula (4)

Example 7

625 g (1 mol) of the amine-ethoxylate of Example 1 were admixed with 570 g (2 mol) of tallow methyl ester ($C_{17}H_{35}COOCH_3$), 1.5 g of solid, pulverulent NaOH and 3 g of sodium hypophosphite and stirred under nitrogen and heated to 180° C. The methanol formed in the course of the reaction was distilled off. After about 90% of the theoretical quantity of methanol had been removed, a vacuum of about 20 mbar was applied to complete the transesterification. About 7 hours produced 1.135 g of a yellow liquid of general formula (4) where a+c=6.6 b=0 d+e+f+g=m=4

$R^7$, $R^8$, $R^9$, $R^{10}$=H 2 of ($R^1$, $R^2$, $R^3$, $R^4$)=H 2 of ($R^1$, $R^2$, $R^3$, $R^4$)=—C(O)—$C_{17}H_{33}$

The compound had the following analysis numbers:

| | |
|---|---|
| TOT = | 98 mg KOH/g |
| TERT = | 97 mg KOH/g |
| OHN = | 93 mg KOH/g |
| SN = | 106 mg KOH/g |

The examples listed in Table II were prepared in a similar manner to Example 7.

TABLE II

| | Example of | | Fatty acid (ester) | | Resulting compound of formula 4 where $R^1$, $R^2$ | $R^3$, $R^4$ | | | | |
|---|---|---|---|---|---|---|---|---|---|---|
| Ex. | Table I | mol | $C_n$ | mol | n × H | n × ester | TOT | TERT | OHN | SN |
| 7 | 1 | 1 | 18[a)] | 2 | 2 | 2 | 98 | 97 | 93 | 106 |
| 8 | 1 | 1 | 18 | 3 | 1 | 3 | 78 | 74 | 57 | 117 |
| 9 | 2 | 1 | 18 | 2 | 2 | 2 | 89 | 88 | 88 | 82 |
| 10 | 5 | 1 | 18 | 2 | 2 | 2 | 86 | 85 | 86 | 91 |
| 11 | 3 | 1 | 18 | 2 | 2 | 2 | 121 | 121 | 118 | 127 |
| 12 | 1 | 1 | 18[b)] | 2 | 2 | 2 | 93 | 93 | 95 | 98 |
| 13 | 1 | 1 | 18[a)] | 1 | 3 | 1 | 128 | 128 | 64 | 191 |

[a)]Tallow methyl ester
[b)]Tallow fatty acid

III. Preparation of quaternary ammonium compounds or amine salts

Example 14

To 1.149 g (1 mol) of the ester of Example 7 were added at 60° C. with stirring 252 g (2 mol) of dimethyl sulfate in portions so that the temperature of the reaction mixture was maintained between 60°-70° C. This produced 1.397 g of a yellow liquid of formula (1) where a+c+b=n a+c=6.6 b=0 d+e+f+g=m=4

$R^7$, $R^8$, $R^9$, $R^{10}$=H 2 of ($R^1$, $R^2$, $R^3$, $R^4$)=H 2 of ($R^1$, $R^2$, $R^3$, $R^4$)—C(O)—$C_{17}H_{35}$ $R^6$ and $R^7$=—$CH_3$

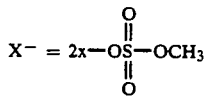

The analysis numbers of these compounds are:

Cat $SO_3$ acid: 9.6 g of $SO_3$/ 100 g

TOT: 2.3 mg of KOH/g

The examples listed below in Table II were carried out in a similar manner to Example 14.

TABLE III

| Ex. | Example of Table II | mol | Quaternizing Agent/Acid mol | Resulting compounds of formula A where $R^6$, $R^7$ | $X^-$ | Cat $SO_3$ | TOT | pH[a)] |
|---|---|---|---|---|---|---|---|---|
| 14 | 7 | 1 | 2 Dimethyl sulfate | $CH_3$ | 2 | 9.6 | 2.3 | |
| 15 | 7 | 1 | 2 Lactic acid | H | 2 | 10.0 | | 5.2 |
| 16 | 7 | 1 | 1 Dimethyl sulfate[b)]<br>1 Lactic Acid | 1 $CH_3$ | 2 | 10.1 | | |
| 17 | 10 | 1 | 2 Dimethyl sulfate | $CH_3$ | 2 | 9.0 | 2.2 | |
| 18 | 7 | 1 | 2 HCl | H | 2 | 10.3 | | 4.2 |

[a)]pH in 1:1 isopropanol/water at 20° C.

[b)]at 60-70° C. in that order

IV. Application testing

A) Preparation of fabric softener solutions or dispersions

Method 1

Charge water, dye solution and optionally an aliquot of electrolyte at 15° C. Gradually emulsify in the component at 23° C. with stirring (propeller stirrer) or emulsify in the components in succession or as a mixture under identical conditions. During the emulsifying add further aliquots of electrolyte if necessary. Then add the perfume oil with stirring and if necessary after the emulsifying process the remaining electrolyte to adjust the viscosity.

The result is a homogeneous emulsion or solution.

Method 2

Charge water, dye solution and optionally an aliquot of electrolyte at 45° C. Gradually emulsify in the component at 55° C. with stirring (propeller stirrer) or emulsify in the components in succession or as a mixture under identical conditions. During the emulsifying add further aliquots of electrolyte if necessary.

Stir the batch until it has cooled down to about 25° C. Then add the perfume oil with stirring and if necessary adjust the viscosity with the remaining electrolyte.

The result is a homogeneous emulsion or solution.

B) Verification of soft fabric hand

To assess the fabric hand, the textile material, made of wool, cotton, 50:3 polyester/cotton and polyester, is treated for about 10 minutes with a liquor comprising tap water (about 9° German hardness and a temperature of 15°-20° C.) and the novel emulsion, dispersion or solution. The concentration of the compounds according to the present invention in the liquor is 0.025% by weight, based on the total active ingredient. The dried textiles were checked by nine people with experience in the assessment of the softness of textiles in respect of their soft fabric hand and assessed against textiles which had not been treated with fabric softeners. The assessments are rated according to a graduated point system, the final reported result being the arithmetic average. After drying, the textile materials treated have an excellent soft fluffy fabric hand and, compared with commercially available agents, a much improved remoisture capability.

C) Examples

Example 1

15.0 g of a compound according to formula (1) wherein three of $R^1$, $R^2$, $R^3$ and $R^4$ were radicals in which $R^5$ was $C_{8-18}$ acyl and one of them was a radical in which $R^5$ was —H; all R groups were —H; $R^6$ and $R^7$ were —H; the average value of n was 5.6; and $X^{-x}$ was lactate;

0.7 g of dye (1% solution of SANDOLAN® milling blue NBL 150; from Sandoz)

to 100.0 g water of 13° German hardness Introduce water-dye solution at 45° C., emulsify in the component at 55° C. with stirring (propeller stirrer) and then stir the batch until cold. The result is a homogeneous emulsion. Viscosity (20° C. measured with Brookfield LVT, spindle 1 at 30 rpm): < 100 mPa.s The examples which follow were prepared in a similar manner to Example 1.

Example 2

30.0 g of a compound according to formula (1) wherein three of $R^1$, $R^2$, $R^3$ and $R^4$ were radicals in which $R^5$ was $C_{8-18}$ acyl and one of them was a radical in which $R^5$ was —H; all R groups were —H; $R^6$ and $R^7$ were —H; the average value of n was 5.6; and $X^{-x}$ was lactate;

1.3 g of dye to 100.0 g water of 13° German hardness The result is a homogeneous emulsion. Viscosity about 10 mPa.s Example 3

15.0 g of a compound according to formula (1) wherein two of $R^1$, $R^2$, $R^3$ and $R^4$ were radicals in which $R^5$ was $C_{8-18}$ acyl, and two of them were radicals in which R was —H; all R groups were —H; $R^6$ and $R^7$ were —$CH_3$; the average value of n was 5.6; and $X^{-x}$ was methylsulfate;

0.7 g of dye to 100.0 g water of 13° German hardness The result is a clear solution. Viscosity < 100 mPa.s Remoisture capability = 94%

Example 4

15.0 g of a compound according to formula (1) wherein three of $R^1$, $R^2$, $R^3$ and $R^4$ were radicals in which $R^5$ was $C_{8-18}$ acyl, and one of them was a radical in which $R^5$ was —H; all R groups were —H; $R^6$ and $R^7$ were —$CH_3$; the average value of n was 5.6; and $X^{-x}$ was methylsulfate;

0.7 g of dye to 100.0 g water of 13° German hardness The result is a homogeneous solution. Viscosity < 100 mPa.s Example 5

15.0 g of a compound according to formula (1) wherein two of $R^1$, $R^2$, $R^3$ and $R^4$ were radicals in which $R^5$ was $C_{8-18}$ acyl, and two were radicals in which $R^5$ was —H; all R groups were —H; $R^6$ was $—CH_3$; $R^7$ was —H; the average value of n was 5.6; and $X^{-x}$ was both methylsulfate and chloride;

0.7 g of dye to 100.0 g water of 13° German hardness The result is a clear solution. Viscosity<100 mPa.s Remoisture capability>90%

EXAMPLE 6

3.0 g of a compound according to formula (1) wherein two of $R^1$, $R^2$, $R^3$ and $R^4$ were radicals in which $R^5$ was $C_{8-18}$ acyl and two of them were radicals in which $R^5$ was —H; all R groups were —H; $R^6$ and $R^7$ were $—CH_3$; the average value of n was 5.6; and $X^{-x}$ was methylsulfate; 12.0 g of a second compound according to formula (1) wherein two of $R^1$, $R^2$, $R^3$ and $R^4$ were radicals in which $R^5$ was $C^{8-18}$ acyl, and two were radicals in which $R^5$ was —H; all R groups were —H; $R^6$ and $R^7$ were —H; the average value of n was 5.6; and $X^{-x}$ was lactate;

0.7 g of dye to 100.0 g water of 13° German hardness The result is a clear solution.

Viscosity<100 mPa.s

Remoisture capability=95%

Example 7

15.0 g of a compound according to formula (1) wherein three $R^1$, $R^2$, $R^3$ and $R^4$ were radicals in which $R^5$ was $C_{8-18}$ acyl, and one was a radical in which $R^5$ was —H; all R groups were —H; $R^6$ and $R^7$ were $—CH_3$; the average value of n was 5.6; and $X^{-x}$ was methylsulfate;

15.0 g of a compound according to formula (1) wherein three $R^1$, $R^2$, $R^3$ and $R^4$ were radicals in which $R^5$ was $C_{8-18}$ acyl, and one was a radical in which $R^5$ was —H; all R groups were —H; $R^6$ and $R^7$ were $—CH_3$; the average value of n was 5.6; and $X^{-x}$ was lactate;

0.7 g of dye to 100.0 g water of 13° German hardness The result is a Viscosity about 200 mPa.s Viscosity about 200 mPa.s Remoisture capability about 85%

What is claimed is:

1. An aqueous fabric softener composition comprising

A) 5–35% by weight based on the softener composition, of one or more compounds of the general formula (1)

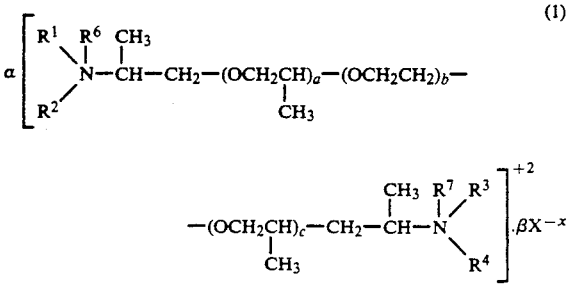

(1)

wherein $R^1$, $R^2$, $R^3$ and $R^4$ are identical or different radicals of the formula $R^5$-(O—CH(R)—$CH_2)_m$—wherein each $R^5$ is H or a substituted or unsubstituted acyl radical of 6–22 carbon atoms with or without a double bond, an wherein at least one $R^5$ must be an acyl radical and at least one $R^5$ must be —H;

the radicals R are identical or different, and are each H or $—CH_3$;

$R^6$ and $R^7$ are identical o different, and are each H, $—CH_3$, $—C_2H_5$ or $—C_2H_4OH$;

$X^{-x}$ is one or more anions selected from the group consisting of organic and inorganic anions;

x is 1, 2 or 3;

a, b, and c are each 0–20;

n is the sum of (a+b+c) and is 1–30;

each m is independently 1–5, and the sum of all m values is at least 4; $\beta$ is 1 or 2; and $\alpha$ equals the product $(0.5)(\beta)(x)$; and B) optionally, 10–90% by weight, based on the weight of said one or more compounds of formula (1), of one or more ammonium fabric softening compounds and C) optionally, 1–5% by weight based on the softener compounds, of one or more additives selected from the group consisting of dyes, scents, electrolytes, high molecular weight ether compounds for viscosity regulation, organic solvents and cationic and nonionic surfactants and D) water to 100% by weight based on the softener composition.

2. An aqueous fabric softener composition as claimed in claim 1, comprising 15–30% by weight based on the softener composition, of at least one compound of formula (1) wherein R is $—CH_3$, two or three of the radicals $R^1$, $R^2$, $R^3$ and $R^4$ are each $R^5$—O—$CH_2$-$CH_2$— where $R^5$ is an acyl radical containing 8–18 carbon atoms and one or two of $R^1$, $R^2$, $R^3$ and $R^4$ are HO—$CH_2$—$CH_2$—; n is 1–15; $R^6$ and $R^7$ are identical or different, and are each H or $—CH_3$; and $X^{-x}$ is a radical of a substituted or unsubstituted carboxylic acid having 1–8 carbon atoms in the main chain or methylsulfate or ethylsulfate.

3. An aqueous fabric softener composition as claimed in claim 1, comprising 15–30% by weight based on the softener composition, of at least one compound of formula (1) wherein R is $—CH_3$, three of the radicals $R^1$, $R^2$, $R^3$ and $R^4$ are each $R^5$-O—$CH_2$—$CH_2$—where $R^5$ is an acyl radical containing 8–18 carbon atoms, one of the radicals $R^5$ is HO—$CH_2CH_2$—; n is 2–8; $R^6$ and $R^7$ are each H and X—is lactate.

4. An aqueous fabric softener composition as claimed in claim 1, comprising 15–30% by weight based on the softener composition, of at least one compound of formula (1) wherein two or three of the radicals $R^1$, $R^2$, $R^3$ and $R^4$ are each $R^5$—O—CH($CH_3$)—$CH_2$—where $R^5$ is an acyl radical containing 8–18 carbon atoms and one or two of $R^1$, $R^2$, $R^3$ and $R^4$ are HO—CH($CH_3$)—$CH_2$—; n is 1–15; $R^6$ and $R^7$ are identical or different, and are each —H or $—CH_3$; and $X^{-x}$ is selected from the group consisting of anions of anions of substituted or unsubstituted carboxylic acids containing 1–8 carbon atoms in the principal chain, methylsulfate, and ethylsulfate.

5. An aqueous fabric softener composition as claimed in claim 1, comprising 15–30% by weight being on the softener composition, of at least one compound of formula (1) wherein three of the radicals $R^1$, $R^2$, $R^3$ and $R^4$ are each $R^5$—O—CH($CH_3$)—$CH_2$—where $R^5$ is an acyl radical containing 8–18 carbon atoms; one of $R^1$, $R^2$, $R^3$ and $R^4$ is $HO—CH(CH_3)—CH_2$; n is 2–8; $R^6$ and $R^7$ are —H; and $X^{-x}$ is lactate.

6. An aqueous fabric softener composition as claimed in claim 1, wherein b equals zero.

7. An aqueous fabric softener composition as claimed in claim 2, wherein b equals zero.

8. An aqueous fabric softener composition as claimed in claim 3, wherein b equals zero.

9. An aqueous fabric softener composition as claimed in claim 4, wherein b equals zero.

10. An aqueous fabric softener composition as claimed in claim 5, wherein b equals zero.

11. An aqueous fabric softener composition as claimed in claim 1, comprising 10–50% by weight, based on the weight of said one or more compounds of formula (1), of at least one compound selected from the group consisting of compounds of the general formula (5):

$$R^{11}—CO—NH—R^{13}—N(—R^{12}OH)—COR^{11} \quad (5)$$

where $R^{11}$ is a substituted or unsubstituted alkyl or alkylene radical of 15–21 carbon atoms and $R^{12}$ and $R^{13}$ are divalent $C_1$–$C_3$-alkylene radicals; substituted imidazolines of the general formula (6)

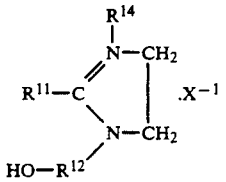

(6)

where $R^{11}$ and $R^{12}$ are each as defined above and $R^{14}$ is H or a $C_1$–$C_4$-alkyl or -hydroxyalkyl radical; compounds of the formula (7)

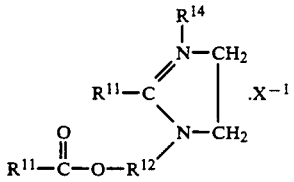

(7)

where $R^{11}$, $R^{12}$ and $R^{14}$ are each as defined above; reaction products of $C_{16}$–$C_{22}$ fatty acids with dialkylenetriamines in a molar ratio of 2:1

$$R^{11}—CO—NH—R^{12}—N(R^{14})—R^{13}—NH-COR^{11}.X^{-1} \quad (8)$$

where $R^{11}$, $R^{12}$, $R^{13}$ and $R^{14}$ are each as defined above; substituted imidazolines of the general formula (9)

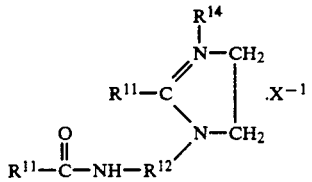

(9)

where $R^{11}$, $R^{12}$ and $R^{14}$ are each as defined above; salts of compounds of the formulae (5) to (9) with organic and/or inorganic acids or in the form of their quaternary compounds; and quaternary ammonium compounds of the general formula (10)

$$^{+}X^{-} \quad (10)$$

where $R^{15}$ is a substituted or unsubstituted alkyl or alkylene radical of 16–22 carbon atoms, $R^{16}$ and $R^{17}$ are independently of one another $C_1$–$C_4$-alkyl or-hydroxyalkyl radicals, $R^{18}$ is the same as $R^{15}$ or $R^{16}$, and $X^-$ is a monovalent organic or inorganic anion.

12. An aqueous fabric softener composition comprising

A) 5–35% by weight based on the softener composition, of one or more compounds of the general formula (1)

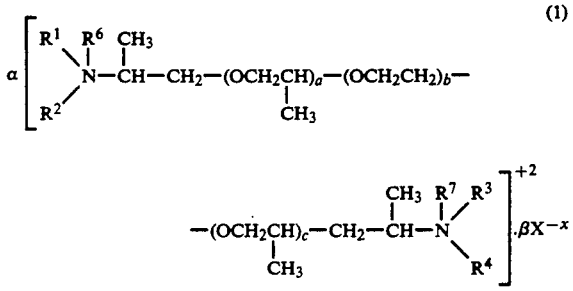

(1)

wherein $R^1$, $R^2$, $R^3$ and $R^4$ are identical or different radicals of the formula $R^5$-(O—CH(R)—$CH_2)_m$- wherein each $R^5$ is H or a substituted r unsubstituted acyl radical of 6–22 carbon atoms with or without a double bond, and wherein at least one $R^5$ must be an acyl radical and at least one $R^5$ must be —H; the radicals R are identical or different, and are each H or $—CH_3$;

$R^6$ and $R^7$ are identical or different, and are each H, $—CH_3$, $—C_2H_5$ or $—C_2H_4OH$;

$X^{-x}$ is one or more anions selected from the group consisting of organic and inorganic anions;

X is 1, 2 or 3;

a, b, and c are each 0–20;

n is the sum of (a+b+c) and is 1–30;

each m is independently 1–5, and the sum of all m values is at least 4; $\beta$ is 1 or 2; and $\alpha$ equals the product $(0.5)(\beta)(x)$; and B) water.

13. An aqueous fabric softener composition as claimed in claim 12, comprising 15–30% by weight based on the softener composition, of at least one compound of formula (1) wherein r is $—CH_3$, two or three of the radicals $R^1$, $R^2$, $R^3$ and $R^4$ are each $R^5—O—CH_2—CH_2$—where $R^5$ is an acyl radical containing 8–18 carbon atoms and one or two of $R^1$, $R^2$, $R^3$ and $R^4$ are $HO—CH_2—CH_2$—; n is 1–15; $R^6$ and $R^7$ are identical or different, and are each H or $—CH_3$; and $X^{-x}$ is a radical of a substituted or unsubstituted carboxylic acid having 1–8 carbon atoms in the main chain or methylsulfate or ethylsulfate.

14. An aqueous fabric softener composition as claimed in claim 12, comprising 15–30% by weight based on the softener composition, of at least one compound of formula (1) wherein R is $—CH_3$, three of the radicals $R^1$, $R^2$, $R^3$ and $R^4$ are each $R^5—O—CH_2—CH_2$—where $R^5$ is an acyl radical containing 8–18 carbon atoms, one of the radicals $R^5$ is $HO—CH_2CH_2—$; n is 2-8; $R^6$ and $R^7$ are each H and X—is lactate.

15. An aqueous fabric softener composition as claimed in claim 12, comprising 15-30% by weight based on the softener composition, of at least one compound of formula (1) wherein two or three of the radicals $R^1$, $R^2$, $R^3$ and $R^4$ are each $R^5—O—CH(CH_3)—CH_2—$where $R^5$ is an acyl radical containing 8-18 carbon atoms and one or two of $R^1$, $R^2$, $R^3$ and $R^4$ are $HO—CH(CH_3)—CH_2—$; n is 1-15; $R^6$ and $R^7$ are identical or different, and are each —H or $—CH_3$; and $X^{-x}$ is selected from the group consisting of anions of substituted or unsubstituted carboxylic acids containing 1-8 carbon atoms in the principal chain, methylsulfate, and ethylsulfate.

16. An aqueous fabric softener composition as claimed in claim 12, comprising 15-30% by weight based on the softener composition, of at least one compound of formula (1) wherein three of the radicals $R^1$, $R^2$, $R^3$ and $R^4$ are each $R^5—O—CH(CH_3)—CH_2—$ where $R^5$ is an acyl radical containing 8-18 carbon atoms; one of $R^1$, $R^2$, $R^3$ and $R^4$ is $HO—CH(CH_3)—CH_2$; n is 2-8; $R^6$ and $R^7$ are —H; and $X^{-x}$ is lactate.

17. An aqueous fabric softener composition as claimed in claim 12, wherein b equals zero.

18. An aqueous fabric softener composition as claimed in claim 13, wherein b equals zero.

19. An aqueous fabric softener composition as claimed in claim 14, wherein b equals zero.

20. An aqueous fabric softener composition as claimed in claim 15, wherein b equals zero.

21. An aqueous fabric softener composition as claimed in claim 16, wherein b equals zero.

22. An aqueous fabric softener composition as claimed in claim 12, comprising 10-50% by weight, based on the weight of said one or more compounds of formula (1), of at least one compound selected from the group consisting of compounds of the general formula (5):

$$R^{11}—CO—NH—R^{13}—N(—R^{12}OH)—COR^{11} \quad (5)$$

where $R^{11}$ is a substituted or unsubstituted alkyl or alkylene radical of 15-21 carbon atoms and $R^{12}$ and $R^{13}$ are divalent $C_1$-$C_3$-alkylene radicals; substituted imidazolines of the general formula (6)

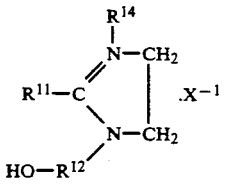

(6)

where $R^{11}$ and $R^{12}$ are each as defined above and $R^{14}$ is H or a $C_1$-$C_4$-alkyl or -hydroxyalkyl radical; compounds of the formula (7)

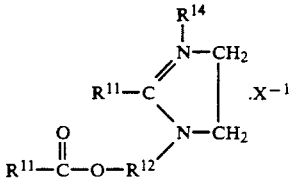

(7)

where $R^{11}$, $R^{12}$ and $R^{14}$ are each as defined above; reaction products of $C_{16}$-$C_{22}$ fatty acids with dialkylenetriamines in a molar ratio of 2:1

$$R^{11}—CO—NH—R^{12}—N(R^{14})_2—R^{13}—NH-COR^{11}.X^{-1} \quad (8)$$

where $R^{11}$, $R^{12}$, $R^{13}$ and $R^{14}$ are each as defined above; substituted imidazolines of the general formula (9)

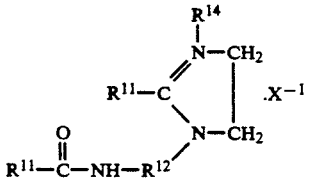

(9)

where $R^{11}$, $R^{12}$ and $R^{14}$ are each as defined above; salts of compounds of the formulae (5) to (9) with organic and/or inorganic acids or in the form of their quaternary compounds; and quaternary ammonium compounds of the general formula (10)

$$^{+}X^{-} \quad (10)$$

where $R^{15}$ is a substituted or unsubstituted alkyl or alkylene radical of 16-22 carbon atoms, $R^{16}$ and $R^{17}$ are independently of one another $C_1$-$C_4$-alkyl or-hydroxyalkyl radicals, $R^{18}$ is the same as $R^{15}$ or $R^{16}$, and $X^-$ is a monovalent organic or inorganic anion.

23. A compound of the general formula (1)

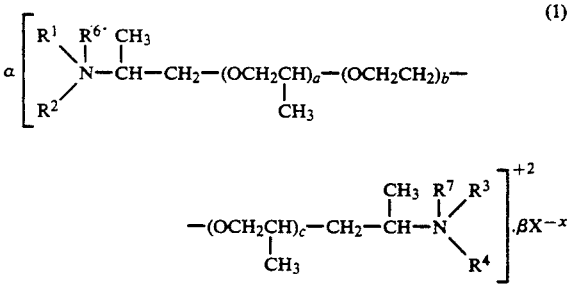

(1)

wherein $R^1$, $R^2$, $R^3$ and $R^4$ are identical or different radicals of the formula $R^5$-$(O—CH(R)—CH_2)_m$—wherein each $R^5$ is H or a substituted or unsubstituted acyl radical of 6-22 carbon atoms with or without a double bond, and wherein at least one $R^5$ must be an acyl radical and at least one $R^5$ must be —H; the radicals R are identical or different, and are each H or $—CH_3$;

$R^6$ and $R^7$ are identical or different, and are each H, $—CH_3$, $—CH_2H_5$ or $—C_2H_4OH$;

$X^{-x}$ is one or more anions selected from the group consisting of organic and inorganic anions;

x is 1, 2 or 3;

a, b, and c are each 0-20;

n is the sum of (a+b+c) and is 1-30;

each m is independently 1-5, and the sum of all m values is at least 4; $\beta$ is 1 or 2; and $\alpha$ equals the product $(0.5)(\beta)(x)$.

24. A compound according to claim 23 wherein R is $—CH_3$, two or three of the radicals $R^1$, $R^2$, $R^3$ and $R^4$ are each $R^5$—O—$CH_2$—$CH_2$—where $R^5$ is an acyl radical containing 8–18 carbon atoms and one or two of $R^1$, $R^2$, $R^3$ and $R^4$ are HO—$CH_2$—CH—; n is 1–15; $R^6$ and $R^7$ are identical or different, and are each H or —$CH_3$; and $X^{-x}$ is a radical of a substituted or unsubstituted carboxylic acid having 1–8 carbon atoms in the main chain or methylsulfate or ethylsulfate.

25. A compound according to claim 23 wherein R is —$CH_3$, three of the radicals $R^1$, $R^2$, $R^3$ and $R^4$ are each $R^5$—O—$CH_2$—$CH_2$—where $R^5$ is an acyl radical containing 8–18 carbon atoms, one of the radicals $R^5$ is HO—$CH_2CH_2$—; n is 2–8; $R^6$ and $R^7$ are each H and X—is lactate.

26. A compound according to claim 23 wherein two or three of the radicals $R^1$, $R^2$, $R^3$ and $R^4$ are each $R^5$—O—CH($CH_3$)—$CH_2$—where $R^5$ is an acyl radical containing 8–18 carbon atoms and one or two of $R^1$, $R^2$, $R^3$ and $R^4$ are HO—CH($CH_3$)—$CH_2$—; n is 1–15; $R^6$ and $R^7$ are identical or different, and are each —H or —$CH_3$; and $X^{-x}$ is selected from the group consisting of anions of substituted or unsubstituted carboxylic acids containing 1–8 carbon atoms in the principal chain, methylsulfate, and ethylsulfate.

27. A compound according to claim 23 wherein three of the radicals $R^1$, $R^2$, $R^3$ and $R^4$ are each $R^5$—O—CH($CH_3$)—$CH_2$—where $R^5$ is an acyl radical containing 8–18 carbon atoms; one of $R^1$, $R^2$, $R^3$ and $R^4$ is HO—CH($CH_3$)—$CH_2$; n is 2–8; $R^6$ and $R^7$ are —H; and $X^{-x}$ is lactate.

28. A compound according to claim 23, wherein b equals zero.

29. A compound according to claim 24, wherein b equals zero.

30. A compound according to claim 25, wherein b equals zero.

31. A compound according to claim 26, wherein b equals zero.

32. A compound according to claim 27, wherein b equals zero.

* * * * *

UNITED STATES PATENT AND TRADEMARK OFFICE

CERTIFICATE OF CORRECTION

PATENT NO. : 5,254,270

DATED : October 19, 1993

INVENTOR(S) : Horst Birkhan, et al.

It is certified that error appears in the above-identified patent and that said Letters Patent is hereby corrected as shown below:

In the Abstract, line 28: ".$\beta X^{-x}$" should read --$\cdot\beta X^{-x}$--

Column 1, line 63: ".$\beta X^{-x}$" should read --$\cdot\beta X^{-x}$--

Column 2, line 22: "8" should read -- --

Column 2, line 22: "($\alpha$)" should read --($\beta$)--

Column 4, lines 15-16: after "formula" insert --(3)--

Column 5, line 27: "80-80°C" should read --40-80°C--

Column 5, line 31: insert as a new paragraph --The preferred anions are accordingly:--

Column 5, line 57: "(-COO-)" should read --($COO^-$)--

Column 6, line 63: ".$X^{-1}$" should read --$\cdot X^{-1}$--

Column 7, lines 5, 19, 30 & 39: ".$X^{-1}$" should read --$\cdot X^{-1}$--

Column 11, line 18, Table III: under "1 $CH_3$" insert --1 H--

Column 12, lines 32, 45, 56 & 68: "mPa.s" should read --mPa·s--

UNITED STATES PATENT AND TRADEMARK OFFICE

CERTIFICATE OF CORRECTION

PATENT NO. : 5,254,270

DATED : October 19, 1993

INVENTOR(S) : Horst Birkhan, et al.

It is certified that error appears in the above-identified patent and that said Letters Patent is hereby corrected as shown below:

Column 13, lines 11, 31 & 47: "mPa.s" should read --mPa·s--

Column 13, line 23: "$C^{8-18}$" should read --$C_{8-18}$--

Column 13, line 47: after "a" insert --homogeneous solution.--

Column 13, line 48: delete second occurrence of "Viscosity about 200 mpa.s"

Column 13, line 65, Claim 1: "$\cdot\beta X^{-x}$" should read --$\cdot\beta X^{-x}$--

Column 14, line 6, Claim 1: "an" should read --and--

Column 14, line 10, Claim 1: "o" should read --or--

Column 14, line 25, Claim 1: "compounds" should read --composition--

Column 14, line 61, Claim 4: delete second occurrence of "of anions"

Column 14, line 65, Claim 5: "being" should read --based--

UNITED STATES PATENT AND TRADEMARK OFFICE

CERTIFICATE OF CORRECTION

PATENT NO. : 5,254,270

DATED : October 19, 1993

INVENTOR(S) : Horst Birkhan, et al

It is certified that error appears in the above-indentified patent and that said Letters Patent is hereby corrected as shown below:

Column 15, lines 30, 43, 53 & 63, Claim 11: ".$X^{-1}$" should read -- $\cdot X^{-1}$--

Column 15, lines 52, Claim 11: "$(R^{14})$" should read --$(R^{14})_2$--

Column 16, line 5, Claim 11: "$^{+}X^{-}$" should read --$[NR^{15}R^{16}R^{17}R^{18}]^{+}X^{-}$--

Column 16, line 28, Claim 12: "$\cdot\beta X^{-x}$" should read --$\cdot\beta X^{-x}$--

Column 16, line 34, Claim 12: "r" should read --or--

UNITED STATES PATENT AND TRADEMARK OFFICE

CERTIFICATE OF CORRECTION

PATENT NO. : 5,254,270

DATED : October 10, 1993

INVENTOR(S) : Horst Birkhan, et al

It is certified that error appears in the above-indentified patent and that said Letters Patent is hereby corrected as shown below:

Column 17, lines 52 & 64, Claim 22: ".$X^{-1}$" should read --·$X^{-1}$--

Column 18, lines 6 & 15, Claim 22: ".$X^{-1}$" should read --·$X^{-1}$--

Column 18, line 26, Claim 22; "$^{+}X^{-}$" should read --$[NR^{15}R^{16}R^{17}R^{18}]^{+}X^{-}$--

Column 18, line 45, Claim 23: ".$\beta X^{-x}$" should read --·$\beta X^{-x}$--

Column 19, line 3, Claim 24: "CH-" should read --$CH_2$- --

Signed and Sealed this

Sixteenth Day of August, 1994

Bruce Lehman

*Attest:*

BRUCE LEHMAN

*Attesting Officer*

*Commissioner of Patents and Trademarks*